US007114624B2

(12) United States Patent
Van Parys

(10) Patent No.: US 7,114,624 B2
(45) Date of Patent: Oct. 3, 2006

(54) FLUID DISTRIBUTION DEVICE HAVING A BOTTLE AND A DECORATIVE CASE

(75) Inventor: Laurent Van Parys, Oyonnax (FR)

(73) Assignee: Qualipac, Neuilly-sur-Seine (FR)

( * ) Notice: Subject to any disclaimer, the term of this patent is extended or adjusted under 35 U.S.C. 154(b) by 280 days.

(21) Appl. No.: 10/673,256

(22) Filed: Sep. 30, 2003

(65) Prior Publication Data

US 2004/0060890 A1 Apr. 1, 2004

(30) Foreign Application Priority Data

Oct. 1, 2002 (FR) ..... 02 12121

(51) Int. Cl.
*B65D 23/00* (2006.01)
*B65D 77/04* (2006.01)
*B65D 85/00* (2006.01)

(52) U.S. Cl. ..... 215/12.1; 215/235; 215/386; 220/23.87

(58) Field of Classification Search ..... 215/10, 215/11.6, 12.1, 13.1, 235, 386; 206/514; 220/23.87, 23.91
See application file for complete search history.

(56) References Cited

U.S. PATENT DOCUMENTS 704,972 A * 7/1902 Griffith ..... 215/12.1
770,528 A * 9/1904 Kestner ..... 215/12.1
1,887,298 A * 11/1932 Friedman ..... 215/12.1
2,328,338 A * 8/1943 Hauptman ..... 215/12.1
2,623,229 A * 12/1952 Brinton ..... 401/128
2,859,891 A * 11/1958 Carkin ..... 215/11.3
3,900,121 A * 8/1975 Kruck ..... 215/12.1
4,892,206 A * 1/1990 Perrin ..... 215/12.1
5,094,363 A * 3/1992 Monahan et al. ..... 222/131
5,125,521 A * 6/1992 Somogyi ..... 215/12.1
5,429,254 A * 7/1995 Christine ..... 215/11.1
5,429,263 A * 7/1995 Haubenwallner ..... 220/23.91

FOREIGN PATENT DOCUMENTS

FR 1 287 487 3/1962
FR 2 402 592 4/1979
FR 2620913 A1 * 3/1989

* cited by examiner

*Primary Examiner*—Sue A. Weaver
(74) *Attorney, Agent, or Firm*—Young & Thompson

(57) ABSTRACT

A fluid distribution device, in particular of cosmetic product, of the type including a bottle adapted to contain fluid and having a distribution orifice. A decorative case covers the bottle. The case has a body and retaining elements adapted to retain the body with respect to the bottle. The retaining elements include a collar integral with the decorative case and an articulation element connecting the collar to the body. The collar includes an internal passage traversing the collar from one side to the other and an external section inserted tightly in the distribution orifice of the bottle.

3 Claims, 3 Drawing Sheets

FLUID DISTRIBUTION DEVICE HAVING A BOTTLE AND A DECORATIVE CASE

BACKGROUND OF THE INVENTION

The invention relates to a fluid distribution device, in particular of cosmetic product, of the type comprising:

- a bottle adapted to contain the fluid and having a distribution orifice;
- a decorative case covering the bottle at least partially, said case having a body and retaining means adapted to retain the body with respect to the bottle.

A device of this type is a relatively top-of-the-range product with a sophisticated aesthetic. The object of the invention is to simplify a device of this type in order to reduce its cost while retaining the same quality.

SUMMARY OF THE INVENTION

According to the invention, the retaining means comprise, for this purpose:

- a substantially cylindrical collar integral with the decorative case (i.e. forming a monobloc assembly with the case) comprising:
  - an internal passage traversing the collar from one side to the other;
  - an external section which is inserted tightly in the distribution orifice of the bottle;
- articulation means connecting the collar to the body.

As the collar is articulated with respect to the body, the decorative case and the retaining means may be moulded in one piece with the collar in a position such that they have no undercut. Moreover, the decorative case can be readily secured on the bottle by pivoting the collar in order to insert it in the distribution orifice of the bottle.

According to the invention, in order efficiently to retain the decorative case on the bottle, it is advantageous for:

- the bottle to comprise a neck incorporating the distribution orifice, said neck also comprising an external rim;
- the retaining means also to comprise a support extending around the neck of the bottle, bearing substantially on the external rim.

The neck is thus efficiently retained between the support and the collar, the support and the collar being disposed in the vicinity of one another on either side of the neck.

According to a further advantageous characteristic feature of the invention, the body comprises two main portions enclosing the bottle, the two main portions of the decorative case are connected together by a film forming a hinge integral with the main portions of the body and the decorative case further comprises releasable fastening means in order to hold the two main portions of the body in contact with one another.

A decorative case enclosing the bottle, and enabling its replacement, can thus be produced in one piece.

According to the invention:

- the device also comprises shutter means articulated with respect to the body of the bottle in order selectively to close the internal passage of the collar,
- the body comprises two main portions enclosing the bottle between them, the shutter means being articulated on one portion and the collar on the other portion.

BRIEF DESCRIPTION OF THE DRAWINGS

The invention is set out in further detail in the following description made with reference to the accompanying drawings, in which.

DETAILED DESCRIPTION OF THE PREFERRED EMBODIMENT

Figure 1:
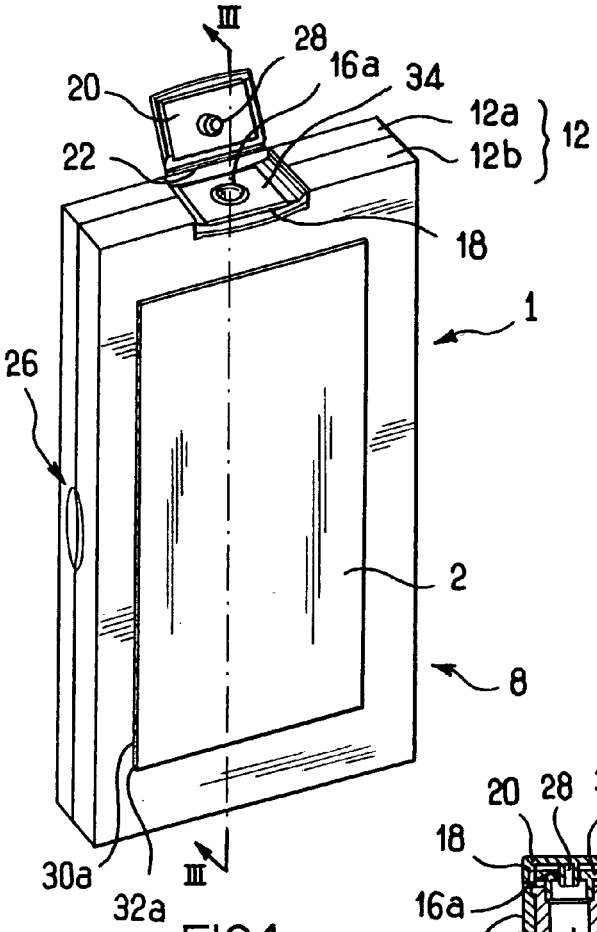
FIG. 1 is a perspective view of a device of the invention, in which a bottle is held in a decorative case.
Figure 2:
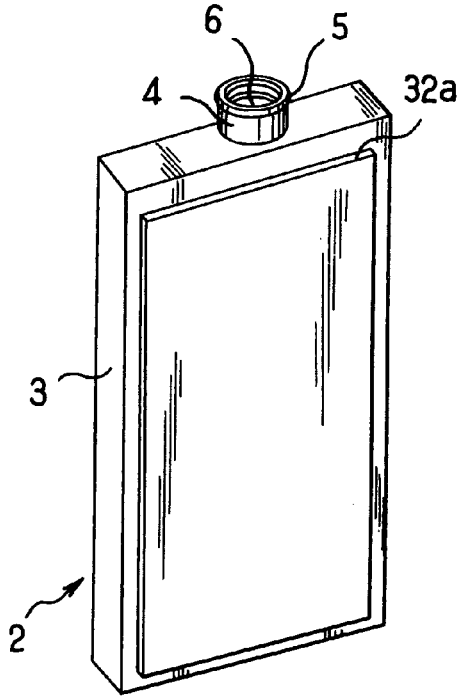
FIG. 2 is a perspective view of the bottle alone.

The device 1 comprises the bottle 2 and the housing 8 forming a decorative case adapted to receive the bottle 2.

The bottle 2 comprises a tank 3 adapted in particular to contain a fluid cosmetic product, and a neck 4 comprising a distribution orifice 6 for the discharge of the cosmetic product.

Figure 3:
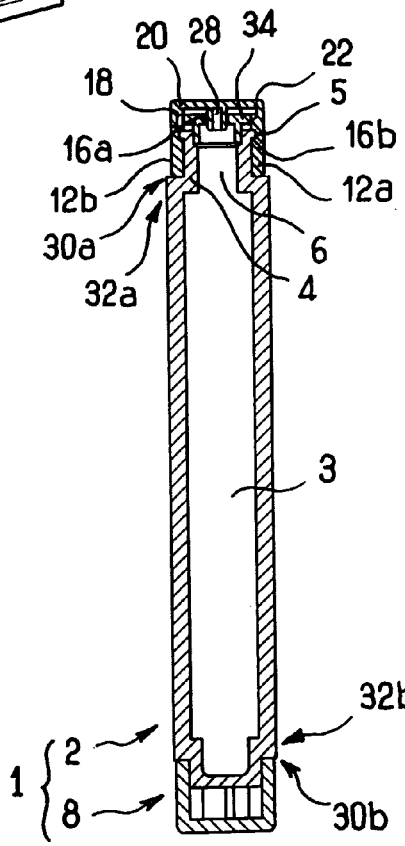
FIG. 3 is a view in cross-section along the line III—III of FIG. 1.
Figure 4:
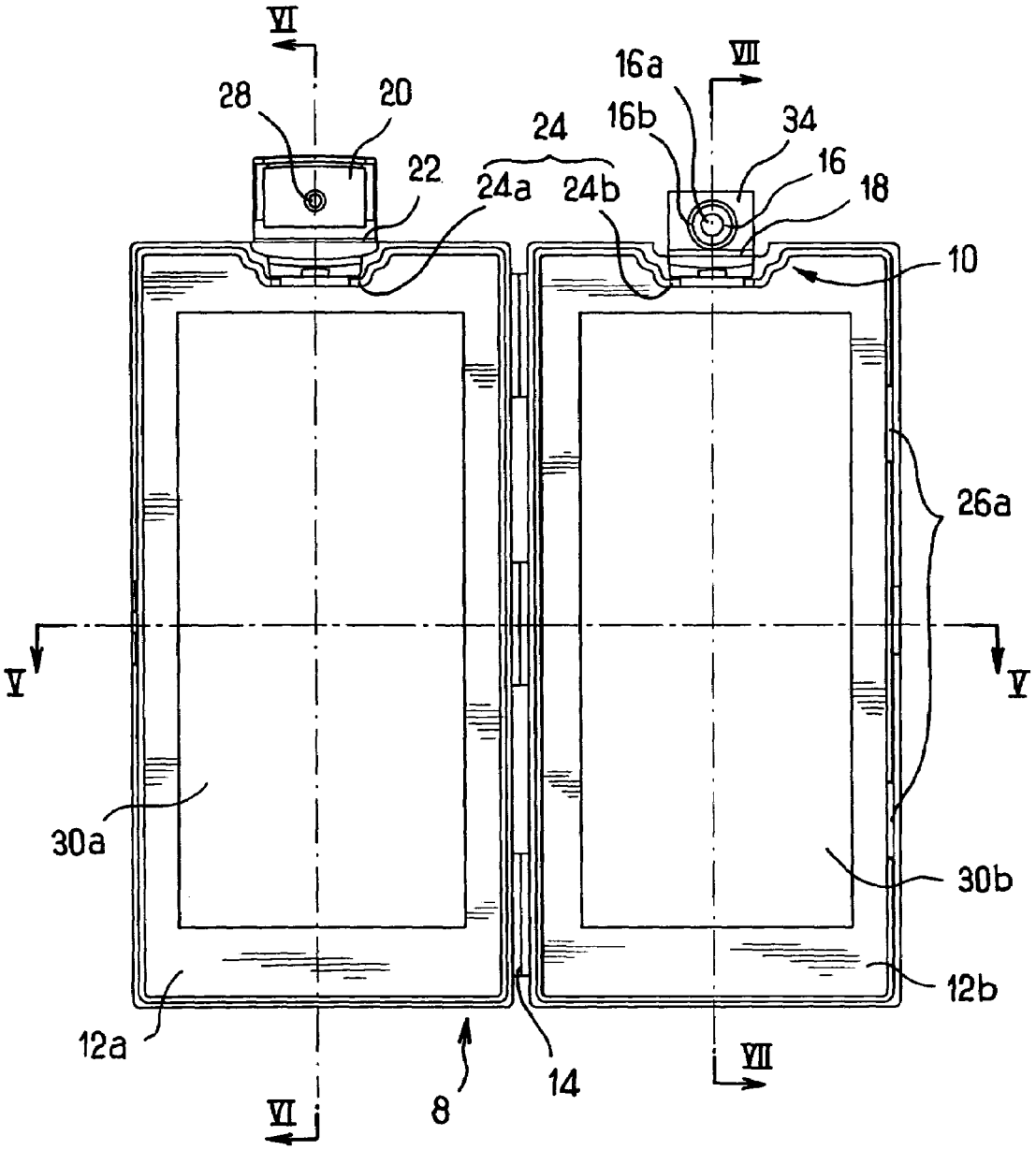
FIG. 4 is a view of the decorative case alone, as obtained from moulding.
Figure 5:
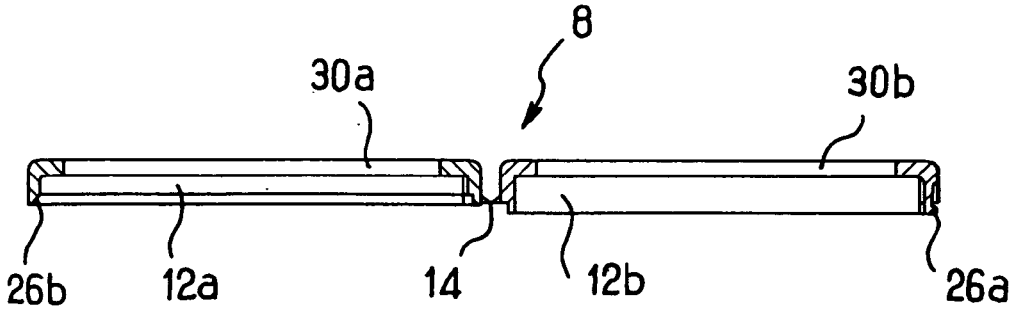
FIG. 5 is a view along the line V—V of FIG. 4.
Figure 6:
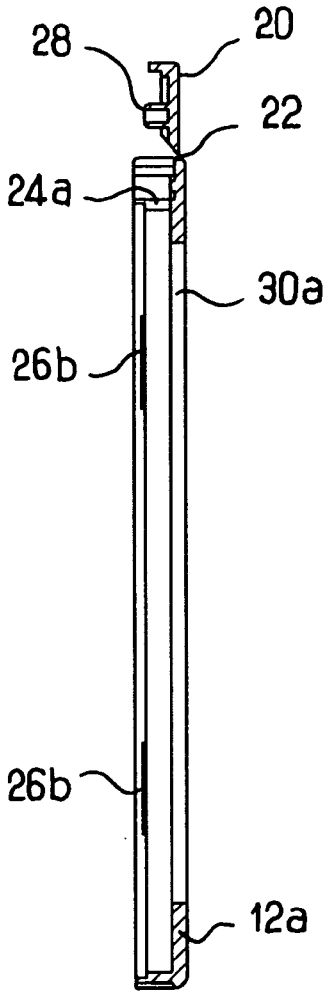
FIG. 6 is a view along the line VI—VI of FIG. 4.
Figure 7:
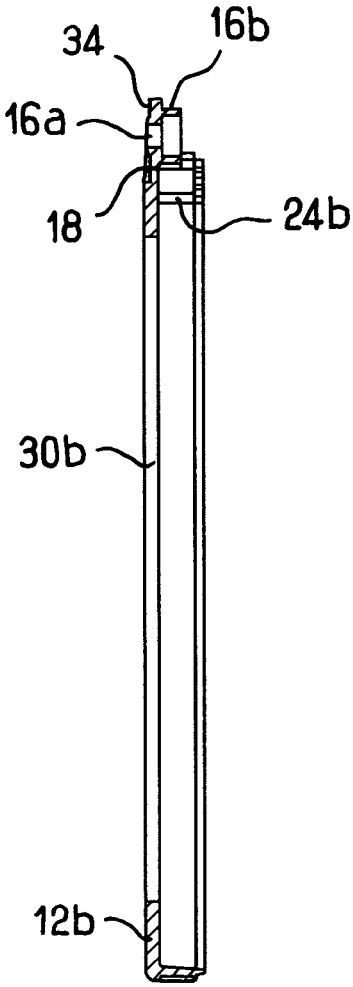
FIG. 7 is a view along the line VII—VII of FIG. 4.

The decorative case essentially comprises a body 12 comprising two portions 12*a*, 12*b* each adapted to be disposed on one side of the bottle, articulated together by a first film hinge 14 (in three parts in this case) and being able to be held in the closed position shown in FIGS. 1 and 3 by means of releasable fastening means 26.

The decorative case further comprises retaining means 10 adapted to retain the bottle with respect to the body 12. These retaining means comprise a support 24 comprising two portions 24*a*, 24*b* each integral with a portion of the body and a collar 16 borne by a base 34 articulated with respect to the portion 12*b* of the body by means of a second film hinge 18.

Each portion 24*a*, 24*b* of the support is substantially U-shaped, with its opening corresponding substantially to the external dimension of the neck 4 of the bottle 2 in order to contain it tightly. These portions 24*a*, 24*b* of the support are disposed substantially facing each other and head on, so as to retain the neck of the bottle between them. The outer surface of the neck 4 of the bottle 2 terminates at a free end in an external rim 5 extending peripherally about the neck and on which the support 24 substantially bears.

Moreover, in order to complete the retention of the bottle 2 with respect to the housing 8, in particular when the housing 8 is open, the collar 16 has an external section 16*b* corresponding substantially to the distribution orifice 6 of the bottle. The collar 16 is thus held firmly and in a leak-tight manner within the neck 4 of the bottle. It also comprises an internal passage 16*a* for the distribution of the cosmetic product.

As shown in FIGS. 4 to 7, the monobloc housing 8 is rigidly moulded with the two portions 12*a*, 12*b* of the body 12 connected together by the first film hinge 14, and the collar 16 and a cap 20 articulated with respect to the portion 12*a* of the body 12 by means of a third film hinge 22.

The housing 8 is moulded in the open position shown in FIGS. 4 to 7, the portions 12*a*, 12*b* of the body, the collar 16 and the cap 20 being in a position such that the housing has no undercuts.

The bottle 2 is then disposed within the portion 12*b* of the body 12 by placing its neck 4 within the portion 24*b* of the support. The collar 16 is then inserted into the distribution orifice 6 of the bottle by pivoting about the hinge 18. The bottle is thus held by means of it neck 4 on the portion 12*b* of the body 12, the rim 5 bearing substantially on the portion 24*b* of the support 24.

The housing 8 is then closed by articulation about the hinge 14, with the portion 24*a* of the support also coming substantially to bear on the rim 5 of the neck 4.

The housing 8 is held in the closed position shown in FIGS. 1 and 3 by means of releasable fastening means 26. These releasable fastening means comprise bosses (beads) 26*a* provided on the portion 12*b* of the body inserted in grooves 26*b* of complementary shape provided in the portion 12*a* of the body.

The cap 20 is articulated with respect to the portion 12*a* of the body 1 by means of the hinge 22 between an open position shown in FIG. 1 and a closed position shown in FIG. 3. It incorporates a stopper 28 which closes the inner passage 16*a* of the collar 16 when the cap is in the closed position.

Each portion 12*a*, 12*b* of the body 12 further comprises a wide opening 30*a*, 30*b* in which a corresponding projecting part 32*a*, 32*b* of the bottle is inserted so as to increase the volume of the bottle for a given size of the device and to see the level of fluid remaining in the bottle when the latter is transparent. This also improves the retention of the bottle 2 with respect to the housing 8.

I claim:

1. A fluid distribution device, comprising:

a bottle adapted to contain the fluid and having a distribution orifice; and a decorative case covering the bottle, said case having a body which comprises two main portions enclosing the bottle between one another, retaining means adapted to retain the body with respect to the bottle, said the retaining means comprising a collar integral with the decorative case and having an an internal passage traversing the collar from one side to another, an external section inserted tightly in the distribution orifice of the bottle, and articulation means connecting the collar to the body, and shutter means articulated with respect to the body so as to selectively close the internal passage of the collar, wherein the shutter means is articulated on one of said two main portions and the collar on another one of said two main portions.

2. A device as claimed in claim 1, wherein:

the bottle comprises a neck internally incorporating the distribution orifice, said neck also comprising an external rim;

the retaining means further comprise a support extending around the neck of the bottle, substantially bearing on the external rim.

3. A fluid distribution device, comprises:

a bottle adapted to contain fluid and having a distribution orifice;

a decorative case covering the bottle, said case having a body which comprises two main portions enclosing the bottle between one another, and retaining means adapted to retain the body with respect to the bottle, said retaining means including a collar integral with the decorative case and comprising an internal passage traversing the collar from one side to another, an external section inserted tightly in the distribution orifice of the bottle, and articulation means connecting the collar to the body, wherein the two main portions of the decorative case are connected together by a film forming a hinge integral with said main portions of the body, and the decorative case further comprises releasable fastening means adapted to keep the two main portions of the body in contact with one another.

* * * * *